United States Patent [19]

Bundy

[11] Patent Number: 4,981,178

[45] Date of Patent: Jan. 1, 1991

[54] APPARATUS FOR COMPRESSED AIR FOAM DISCHARGE

[76] Inventor: Eric D. Bundy, 340 S.E. 1st, Newport, Oreg. 97365

[21] Appl. No.: 494,584

[22] Filed: Mar. 16, 1990

[51] Int. Cl.[5] ..... A62C 35/00

[52] U.S. Cl. ..... 169/9; 169/13; 169/15

[58] Field of Search ..... 169/5, 6, 9, 13, 14, 169/15, 19, 26, 30, 71, 78, 85, 88, 89, 91, 44

[56] References Cited

U.S. PATENT DOCUMENTS

| | | | |
|---|---|---|---|
| 2,988,151 | 6/1961 | Dion-Biro | 169/78 |
| 4,278,132 | 7/1981 | Hostetter | 169/15 |
| 4,345,654 | 8/1982 | Carr | 169/13 |
| 4,474,680 | 10/1984 | Kroll | 169/15 |
| 4,492,525 | 1/1985 | Bilyeu | 69/13 |
| 4,729,434 | 3/1988 | Rohrbach | 169/9 |

*Primary Examiner*—Sherman Basinger
*Assistant Examiner*—Stephen P. Avila
*Attorney, Agent, or Firm*—Klarquist, Sparkman, Compbell, Leigh & Whinston

[57] ABSTRACT

Fire fighting foam discharge is produced by introducing water, surfactant, and compressed air into a single mixing chamber from separate sources. A power source includes an internal combustion engine coupled by operator-controlled clutch to an output shaft for driving concurrently a water pump and air compressor.

7 Claims, 5 Drawing Sheets

APPARATUS FOR COMPRESSED AIR FOAM DISCHARGE

BACKGROUND OF THE INVENTION

The present invention relates to fire fighting apparatus, and particularly to foam discharge for fighting fires.

Cities have water delivery systems with fire hydrants for providing a source of fire fighting water. Unfortunately, such a plentiful water supply is not always available to fight fires. Many rural areas do not have a fire hydrant system. Similarly, no water supply is available in many remote areas. Consequently, to fight fires in such areas, water must be carried to the fire. Large water tanks carried on trucks and in aircraft aid in bringing water to a fire site, but when these tanks are empty it is difficult or impossible to successfully fight the fire. Water, therefore, is always a precious commodity when fighting fires, especially where the water must be carried to the fire site.

To extend a water supply at a fire site, it is known to intermix water with a surfactant, i.e., soap, to create a foam discharge for wetting and extinguishing the fire. In accordance with such known methods, the foam is generated in the turbulence of the water and surfactant mixture as it travels along a conduit. In many cases, 30 to 100 feet of conduit are required to provide sufficient turbulence to produce the desired foam discharge.

It is desirable to produce as much foam discharge as possible from a given volume of water. In this manner, the precious resource, water, is more fully used.

SUMMARY OF THE INVENTION

It is, therefore, an object of the present invention to provide a foam discharge having greater volume for each gallon of water used. In this manner, a limited water supply carried to a remote fire site produces more fire fighting product and is, therefore, more effective in extinguishing the fire.

It is a further object of the present invention to produce the foam within a mixing chamber. In this manner, it is not necessary to use long sections of conduit within which turbulence produces the foam. Accordingly, a foam discharge device in accordance with the present invention is more compact and may be provided with shorter conduits. For example, as a deck gun mounted to a fire truck where it is not practical to provide the 30 to 100 feet of conduit otherwise required to produce the foam discharge.

The foregoing objects and advantages are achieved in an apparatus and method for foam discharge by chamber expansion where water, surfactant, and compressed air first join inside a single mixing chamber in line with a discharge nozzle. By such method, a greater volume of foam discharge is achieved with a given volume of water.

In accordance with one aspect of the invention, water pressure and air pressure are substantially matched as these materials enter the mixing chamber. The volume of water and air are then varied to achieve a desired character of foam discharge. The foam discharge may be either dry or wet foam discharge. When providing a relatively greater volume of air, it is possible to more efficiently use the water to obtain a greater volume of foam discharge per given volume of water.

In accordance with a second aspect of the present invention, a single internal combustion engine coupled by way of an operator actuated clutch to an air compressor and a water pump provides a power supply for introducing the water and air into the mixing chamber. Engine RPM thereby controls water pressure and air volume, an air regulator determines air pressure, and a control valve determines water volume.

The subject matter of the present invention is particularly pointed out and distinctly claimed in the concluding portion of this specification. Both the organization and method of operation of the invention, together with further advantages and objects thereof, however, may best be understood by reference to the following description and accompanying drawings wherein like reference characters refer to like elements.

DETAILED DESCRIPTION

Figure 1:
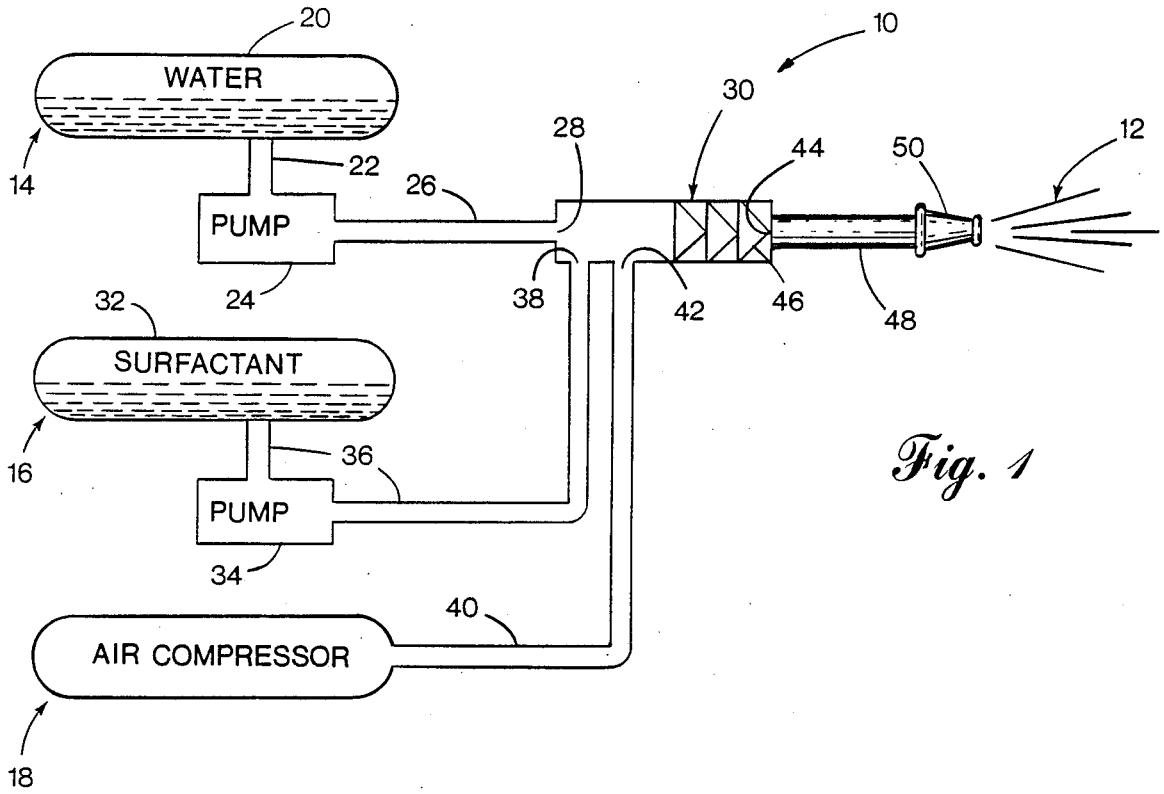
FIG. 1 is a simplified diagram of a foam discharge device in accordance with the present invention.

In accordance with a principal embodiment of the present invention, a foam discharge device 10 produces a fire fighting foam discharge 12 and includes a water source 14, a surfactant source 16, and a compressed air source 18. Water source 14 includes a water tank 20 coupled by a conduit 22 to a water pump 24. Water pump 24 provides water by way of conduit 26 to a water inlet 28 of a mixing chamber 30. Surfactant source 16 includes a surfactant tank 32 coupled to a surfactant pump 34 by way of conduit 36. Surfactant pump 34 provides surfactant along conduit 36 to a surfactant inlet 38 of mixing chamber 30. Compressed air source 18 provides compressed air along conduit 40 to a compressed air inlet 42 of mixing chamber 30.

Mixing chamber 30 is generally tubular with an upstream end forming the water inlet 28 and downstream end forming a foam outlet 44. A KOMAX three inch static mixer has been found satisfactory as mixer 30, however, it is believed that a variety of similar such static mixers are equally acceptable. Near the foam outlet 44, but interior to the mixing chamber 30, are mixing blades 46, shown schematically. As seen in FIG. 1, both the surfactant inlet 38 and compressed air inlet 42 of mixing chamber 30 are intermediate of the water inlet 28 and mixing blades 46, with the surfactant inlet 38 being intermediate of the water inlet 28 and the compressed air inlet 42. Foam outlet 44 couples by way of conduit 48 to a nozzle 50 from which the foam discharge 12 is expelled.

Thus, mixing chamber 30 lies in line with conduit 26 and conduit 48. Water provided by water source 14 enters the upstream end, i.e., water inlet 28, of mixing chamber 30. As the water enters mixing chamber 30, both surfactant and compressed air also enter mixing chamber 30 just upstream of the mixing blades 46. Foam then forms within mixing chamber 30. As a result of expansion due to such foam formation, foam discharge 12 is forced out of mixing chamber 30 by way of foam outlet 44 along conduit 48 and out nozzle 50. It may be appreciated that by producing the foam within mixing chamber 30, the conduit 48 may be very short as compared to prior methods of producing foam discharge which require some 30 to 100 feet of conduit for providing foam generating turbulence therein. It is believed that the method of introducing water, surfactant, and compressed air into a single mixing chamber contributes to a larger volume of foam discharge per a given volume of water than previously known methods of producing foam discharge.

Foam discharge 12 is desirably produced by the proper combination of air pressure and volume with the appropriate pressure and volume of water. Precise control over the inputs to mixing chamber 30 determines the quality and character of foam discharge 12.

As will be discussed in greater detail hereafter, the pressure of both the air and water provided to mixing chamber 30 must be substantially equal. Because both materials enter the same mixing chamber, the pressures should substantially match in order to avoid a situation where one is introduced at a greater pressure thereby forcing the other back out of mixing chamber 30.

As for volume control, a basic formula is to provide one cubic foot of air per one gallon of water. As these values are varied, the character of the foam discharge 12 varies. The volume of air or the volume of water may be varied. For example, increasing the amount of air, or decreasing the amount of water, provides a dryer foam discharge 12. Similarly, increasing the amount of water, or decreasing the amount of air, provides a wetter foam discharge 12. It may be appreciated, therefore, that use of foam discharge device 10 requires some level of expertise in manipulating the amount of air and water introduced into mixing chamber 30. However, once an operator becomes familiar with these controls, it is possible to achieve the desired foam discharge 12 characteristics.

Figure 4:
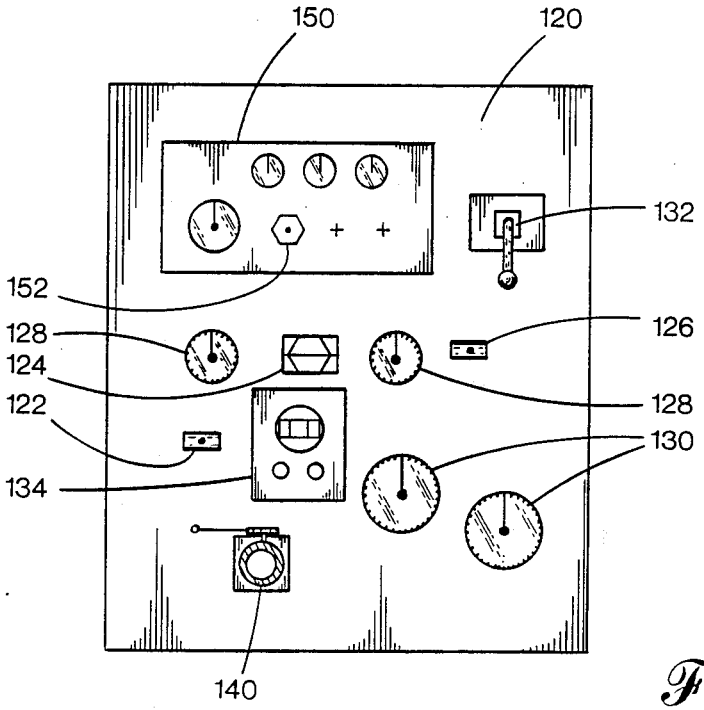
FIG. 4 is a diagram of a control panel for the foam discharge device.
Figure 2:
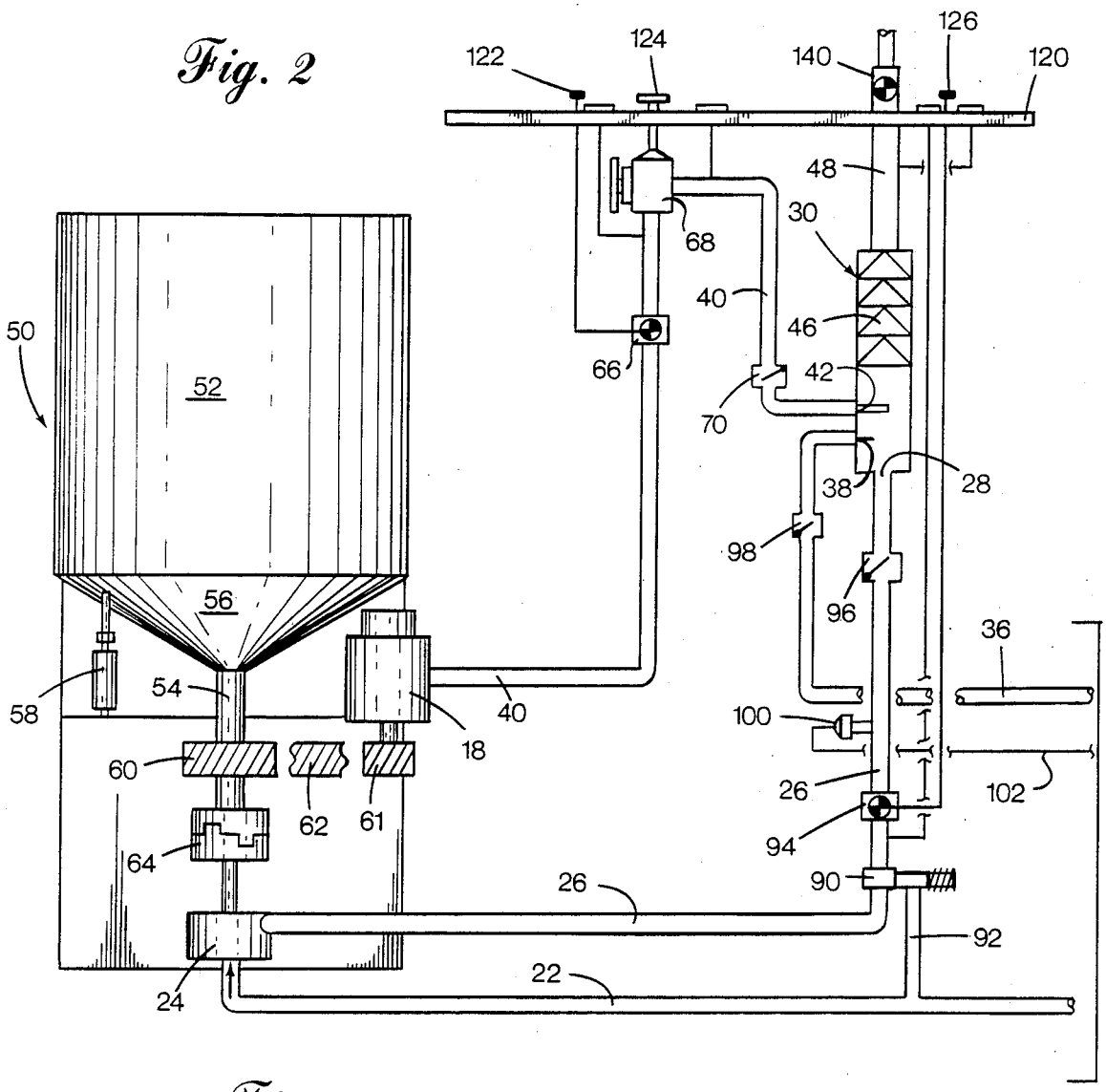
FIG. 2 is a diagram of a drive mechanism and plumbing portion of the foam discharge device of FIG. 1.
Figure 3:
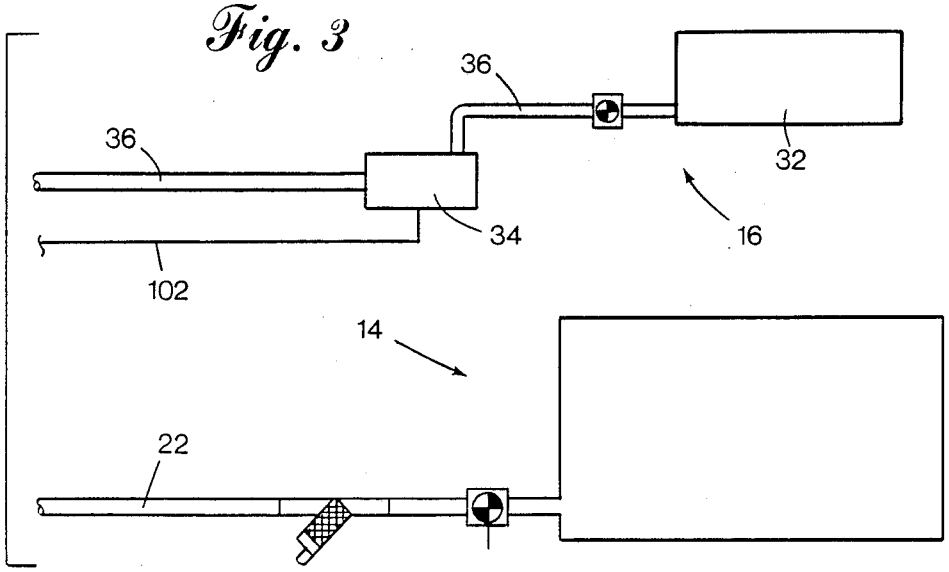
FIG. 3 is a diagram of water source and surfactant source portion of the foam discharge device of FIG. 1.

FIGS. 2–4 further illustrate foam discharge device 10 including control mechanisms for determining the amount of water, surfactant, and compressed air introduced into mixing chamber 30, and a power source for driving pumps 24 and 34. With reference to FIG. 2, a power source 50 includes an internal combustion diesel engine 52 coupled to an output shaft 54 by way of a clutch 56. A clutch actuator 58 selectively couples and decouples output shaft 54 and motor 52. Output shaft 54 carries a drive gear 60 operatively coupled to input shaft 61 of air compressor 18 by way of belt 62. At the distal end of output shaft 54, a coupling 64 connects shaft 54 to input shaft 65 of water pump 24. Thus, with motor 52 running and clutch 56 engaged, pump 24 moves water from conduit 22 into conduit 26 and air compressor 18 pressurizes air within conduit 40. Air compressor 18 and water pump 24 may be energized by operation of actuator 58, and deenergized even when motor 52 remains in operation.

The conduit 40, coupling air compressor 18 and mixing chamber 30, includes a control valve 66 proximal to air compressor 18 and an air regulator 68 intermediate of control valve 66 and mixing chamber 30. Also, a check valve 70 lies in line with conduit 40 just before conduit 40 joins mixing chamber 30. Air inlet 42 terminates conduit 40 for introducing regulated compressed air into mixing chamber 30 just upstream from mixing blades 46. Thus, as described in greater detail hereafter, the amount of compressed air entering mixing chamber 30 is operator-controlled by way of control valve 66 and regulator 68.

The conduit 26, coupling water pump 24 to mixing chamber 30, includes a pressure relief valve 90 and a bypass conduit 92 fluidly connecting valve 90 to conduit 22. Just downstream from valve 90 along conduit 26 is a main discharge water control valve 94. When valve 94 is closed, pressure relief valve 90 responds to back pressure in conduit 26 and allows water pumped by pump 24 into conduit 26 to enter bypass conduit 92 and return to conduit 22. With main valve 94 open, however, pressure relief valve 90 is closed and water flows along conduit 26 to the water inlet 28 of mixing chamber 30. Conduit 26 includes a check valve 96 just upstream of water inlet 28. Thus, main valve 94 controls the volume of water entering mixing chamber 30.

With reference to FIG. 3 in conjunction with FIG. 2, surfactant tank 32 provides surfactant along conduit 36 to surfactant pump 34. Surfactant pump 34 in turn provides surfactant along conduit 36 to surfactant inlet 38 of mixing chamber 30. A check valve 98 lies in line with conduit 36 just before surfactant inlet 38.

The amount of surfactant provided to mixing chamber 30 by surfactant source 16 is a function of the amount of water flowing in conduit 26. A flow sensor 100, positioned along conduit 26 just upstream from check valve 96, couples by electrical conductor 102 to surfactant pump 34. Surfactant pump 34 is a proportional surfactant injection pump, whereby pump 34 responds to the electrical signal provided by sensor 100 in delivering surfactant to mixing chamber 30 by way of conduit 36. Pump 34 may be adjusted to provide surfactant as a given percentage of the volume of water flowing through conduit 26. Typically, pump 34 is set to provide an amount of surfactant equal to 0.1 to 0.5 percent of the water flowing in conduit 26.

With reference to FIG. 2 in conjunction with FIG. 4, a control panel 120 permits operator control over the various valves and regulators of foam discharge device 10. A main air line valve actuator 122 mechanically connects to valve 66 for controlling valve 66 from the control panel 120. Regulator 68, being mounted directly to the backside of control panel 120, is manipulated by operation of a knob 124 extending therethrough. Main discharge water control valve 94 is mechanically coupled to an actuator 126 of control panel 120. Gauges 128 of control panel 120 indicate the regulated and back pressure for air source 18. Gauges 130 of panel 120 indicate water and compressed air foam pressure. An actuator lever 132 of control panel 120 mechanically couples to actuator 58 of power source 50. A flow indicator and percent surfactant controller 134 of control panel 120 permits control over pump 34 and provides an indication of water flow through conduit 26. A compressed air foam discharge control valve 140, positioned on control panel 120 as the terminal portion of conduit 48, provides means for delivering the foam discharge 12 to nozzle 50. Finally, sub-panel 150 of control panel 120 includes controls for engine 52, including a throttle control 152.

Thus, an operator of control panel 20 has control over the introduction of water, surfactant, and compressed air into mixing chamber 30, as well as a visual indication of the pressures and flow conditions present within the various conduits of foam discharge device 10.

In operating foam discharge device 10, an operator must manipulate three basic controls. First, knob 124 controls regulator 68 for determining the air pressure as introduced into mixing chamber 30. Second, actuator 126 controls valve 94 for determining water volume entering mixing chamber 30. Third, throttle 152 controls the RPM of engine 52 and, therefore, controls both water pressure and air volume. Additionally, the operator can adjust the amount of surfactant, as a percentage of water flow, entering chamber 30. Because water pressure and air volume are controlled by one device, i.e., throttle 152, and air pressure and water volume are controlled by separate devices, i.e., knob 124 and actuator 126, respectively, it will be appreciated that these controls are dynamically interrelated during operation. The following procedures for start up and operation will illustrate the basic use of foam discharge device 10.

To use foam discharge device 10, an operator first checks tanks 20 and 32 to insure that a full supply of water and surfactant are available. The operator closes valve 140 to prevent discharge during start up. Next, the operator starts engine 52 with actuator lever 132 in its neutral position to disengage engine 52 from output shaft 54. Engine 52 is then permitted to warm up during the next several setup steps.

The operator insures that surfactant is present in mixing chamber 30. To do this, the operator uses a manual override switch (not shown) for pump 34 to introduce surfactant into mixing chamber 30. It is important to put surfactant into mixing chamber 30 prior to introducing water and air. Without such surfactant in mixing chamber 30, the water and air will not mix immediately and it is possible that production of foam discharge 12 can be delayed for 15 to 20 seconds. By priming mixing chamber 30 with surfactant, the water and air mix immediately upon start up and foam discharge 12 is immediately available.

The operator then moves actuator lever 132 to its engaged position thereby coupling engine 52 to output shaft 54. This brings pump 24 and air compressor 18 on line. The operator adjusts knob 124 to provide a given regulated air pressure for introduction into mixing chamber 30. Typically, the operator adjusts regulator 68 to provide approximately 50 pounds of air pressure. The operator monitors the water pressure and adjusts throttle 152 to bring the engine RPM to a setting where the water pressure matches the regulated air pressure, e.g., approximately 50 pounds. Generally, however, the water pressure may be slightly greater than the air pressure.

Foam discharge device 10 is now ready for operation. To expel foam discharge 12 from nozzle 50, the operator opens valve 140. If the operator desires to provide dryer foam discharge 12, valve 94 is closed slightly to reduce the flow of water into mixing chamber 30. If wetter foam discharge 12 is desired, valve 94 is opened slightly.

In constructing foam discharge device 10, it is important to match the air compressor 18 with the water pump 24. The air compressor 18 must be capable of providing a sufficient amount of air relative to the output capabilities of pump 24. The following engine, water pump, and air compressor configurations have been found satisfactory. In a first configuration, a 20–30 horse power diesel engine 52 is used with a 150 gallon per minute (maximum) water pump 34 and a 46–70 cubic feet per minute (CFM) air compressor 18 having a maximum pressure of 250 pounds per square inch (PSI). In a second configuration, a 55–65 horse power diesel engine 52 is used with a 250 gallon per minute water pump 24 and a 89–150 CFM air compressor 18 having a maximum pressure of 250 PSI. In a third configuration, a 115–130 horse power diesel engine is used with a 1,000 gallon per minute pump 24 and a 190–225 CFM air compressor 18 having a maximum air pressure of 250 PSI. In each of the above-noted configurations, the basic formula of one gallon of water per one cubic foot of air has been achieved.

Typical operational settings for the first noted configuration are 12 gallons per minute of water at 50 pounds, 15 CFM of air at approximately 50 pounds, surfactant provided as 0.1 to 0.5 percent of the volume of water introduced into mixing chamber 30, and an engine RPM setting of approximately 1,800 RPM.

A typical operating configuration for the second noted configuration above, is 35 gallons per minute of water at 50 pounds, 42 cubic feet per minute of air at slightly less than 50 pounds, a surfactant setting of between 0.1 and 0.5 percent of the volume of water introduced into mixing chamber 30, and an engine RPM setting at approximately 1,800 RPM.

Figure 5:
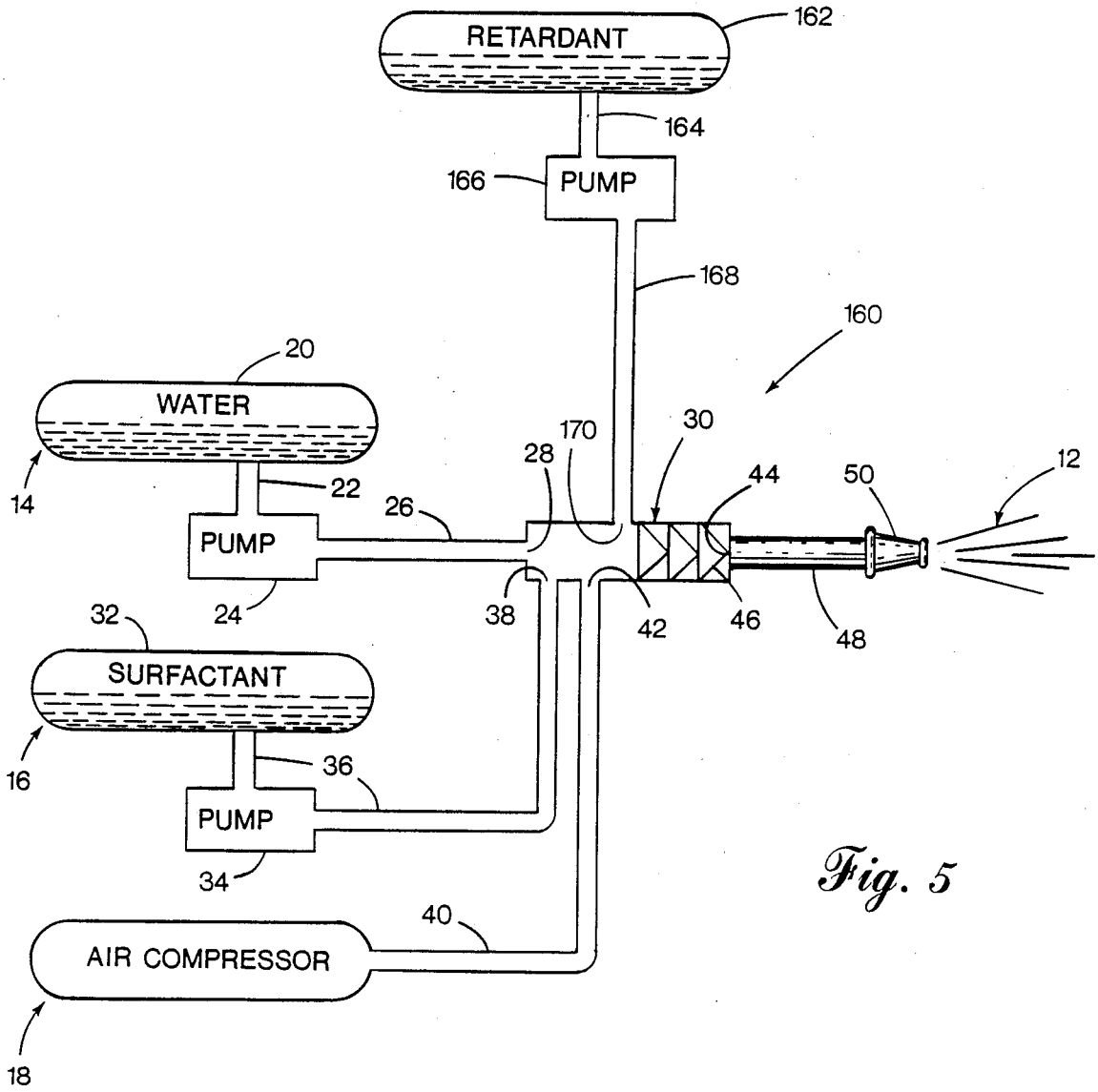
FIG. 5 is a simplified diagram of a foam discharge device similar to the foam discharge of FIG. 1, but including an additional retardant tank for introducing retardant into the foam discharge.

FIG. 5 illustrates a foam discharge device 160 similar to the foam discharge device 10 as illustrated in FIGS. 1–4, but including an additional retardant tank 162 for introducing a fire retardant into the mixing chamber 30. A conduit 164 delivers retardant to a retardant pump 166 similar to the pump 34. Pump 34 then delivers retardant by way of conduit 168 to a retardant inlet 170 of mixing chamber 30. Foam discharge device 160 thereby provides a foam discharge 12 having intermixed therein the fire retardant as a desired percentage of the water flow flowing through conduit 26.

The foam discharge device 160 may be controlled in a manner similar to that of the foam discharge device 10 as shown in FIGS. 2–4. More particularly, the pump 166 may be responsive to the sensor 100 of FIG. 2 for providing retardant as a given percentage of the volume of water flowing through conduit 26. In a typical configuration, the amount of retardant introduced into mixing chamber 30 is between 10 and 20 percent of the water flowing in conduit 26.

Thus, a method and apparatus for foam discharge by chamber expansion has been shown and described. The method and apparatus of the present invention provides greater volume of foam discharge per a given volume of water. The method and apparatus generates the foam discharge within a mixing chamber and eliminates the need for long sections of conduit for providing foam producing turbulence. Also, a single engine drives both the air compressor and the water pump and thereby controls both the water pressure and air volume. Separate controls are provided for the air pressure and water volume for manipulating the character of foam discharge obtained. The foam may be of wetter or drier character, depending on the manipulation of controls. Given some level of expertise, it is possible to substantially maximize the effectiveness of the fire fighting foam discharge.

While a preferred embodiment of the present invention has been shown and described, it will be apparent to those skilled in the art that many changes and modifications may be made without departing from the invention in its broader aspects. The appended claims are, therefore, intended to cover all such changes and modifications as fall within the true spirit and scope of the invention.

I claim:

1. An apparatus for producing a fire fighting foam discharge, the apparatus comprising:

a mixing chamber having at least three inlets and at least one outlet, said mixing chamber comprising:

a substantially tubular structure with an upstream end as said first inlet and a downstream end as said outlet, mixing blades mounted within said tubular structure, a surfactant passage as said second inlet and positioned intermediate of said upstream end and said mixing blades, and a compressed air passage as said third inlet and positioned intermediate of said upstream end and said mixing blades;

a water source coupled to said first inlet of said mixing chamber;

a surfactant source coupled to said second inlet of said mixing chamber;

a compressed air source coupled to said third inlet of said mixing chamber;

control means coupled to said water source, said surfactant source, and said compressed air source for determining the amount of water, surfactant, and compressed air introduced into said mixing chamber; and means coupled to said outlet of said mixing chamber for delivering the intermixed water, surfactant, and air to a fire.

2. An apparatus according to claim 1, wherein said surfactant passage lies intermediate of said upstream end and said compressed air passage.

3. An apparatus according to claim 1, wherein said control means includes sensor means responsive to the volume of water introduced into said mixing chamber for adjusting the volume of surfactant introduced into said mixing chamber whereby a substantially constant surfactant to water ratio is maintained.

4. An apparatus according to claim 1, wherein said control means comprises means for substantially matching water pressure and air pressure as water and air are introduced into said mixing chamber.

5. An apparatus according to claim 1, wherein said control means comprises:

means for controlling water pressure and air volume;

means for controlling water volume; and means for controlling air pressure.

6. An apparatus for producing a first fighting foam discharge, the apparatus comprising:

a mixing chamber having at least three inlets and at least one outlet;

a water source coupled to a first inlet of said mixing chamber;

a surfactant source coupled to a second inlet of said mixing chamber;

a compressed air source coupled to a third inlet of said mixing chamber;

a power source, the power source comprising:

an output shaft coupled to drive an air compressor of said compressed air source and a water pump of said water source, a motor, and a clutch for selectively coupling and decoupling said motor and said output shaft;

control means coupled to said water source, said surfactant source, and said compressed air source for determining the amount of water, surfactant, and compressed air introduced into said mixing chamber; and means coupled to said outlet of said mixing chamber for delivering the intermixed water, surfactant, and air to a fire.

7. An apparatus for producing a fire fighting foam discharge, the apparatus comprising:

a mixing chamber having at least three inlets and at least one outlet;

a water source coupled to a first inlet of said mixing chamber;

a surfactant source coupled to a second inlet of said mixing chamber;

a compressed air source coupled to a third inlet of said mixing chamber;

control means coupled to said water source, said surfactant source, and said compressed air source for determining the amount of water, surfactant, and compressed air introduced into said mixing chamber, said control means comprising:

means for controlling water pressure and air volume, means for controlling water volume, and means for controlling air pressure, said means for controlling water pressure and air volume comprising:

an engine having an output shaft and a throttle control for operating speed adjustment of said engine, a water pump of said water source coupled to said output shaft and fluidly coupled to said mixing chamber for delivering water thereto, said pump providing water at a pressure dependent on said operating speed of said engine, and an air compressor of said air source coupled to said output shaft and fluidly coupled to said mixing chamber for delivering air to said mixing chamber, said air compressor providing air to said mixing chamber of a volume dependent on said operating speed of said engine; and means coupled to said outlet of said mixing chamber for delivering the intermixed water, surfactant, and air to a fire.

* * * * *